US007748395B2

(12) United States Patent
Satoyoshi et al.

(10) Patent No.: US 7,748,395 B2
(45) Date of Patent: Jul. 6, 2010

(54) WASH-TARGET HOLDER AND METHOD FOR WASHING WASH-TARGET USING THE SAME

(75) Inventors: Tatsuya Satoyoshi, Kwai Chung (HK); Morihiro Ohno, Kwai Chung (HK); Osamu Fukuroi, Kwai Chung (HK)

(73) Assignee: SAE Magnetics (H.K.) Ltd., Kwai Chung (HK)

( * ) Notice: Subject to any disclaimer, the term of this patent is extended or adjusted under 35 U.S.C. 154(b) by 727 days.

(21) Appl. No.: 11/065,366

(22) Filed: Feb. 25, 2005

(65) Prior Publication Data

US 2006/0042652 A1 Mar. 2, 2006

(30) Foreign Application Priority Data

Aug. 30, 2004 (JP) ..... 2004-025878
Aug. 30, 2004 (JP) ..... 2004-025881
Oct. 20, 2004 (JP) ..... 2004-305972

(51) Int. Cl.
*B08B 3/00* (2006.01)

(52) U.S. Cl. ..... 134/201; 134/137; 134/184; 134/902; 134/1; 156/345.23

(58) Field of Classification Search ..... None
See application file for complete search history.

(56) References Cited

U.S. PATENT DOCUMENTS 3,964,957 A * 6/1976 Walsh ..... 156/345.23
4,788,992 A * 12/1988 Swainbank et al. ..... 134/64 R
6,589,361 B2 * 7/2003 Luscher et al. ..... 134/33

FOREIGN PATENT DOCUMENTS

| | | |
|---|---|---|
| JP | 6-103511 | 4/1994 |
| JP | 06226221 A * | 8/1994 |
| JP | 11-49276 | 2/1999 |
| JP | 2000-33345 | 2/2000 |

OTHER PUBLICATIONS

English Language Abstract of JP 6-103511.
English language Abstract of JP 2000-33345, Feb. 2, 2000.
English language Abstract of JP 11-49276, Feb. 23, 1999.

* cited by examiner

*Primary Examiner*—Michael Kornakov
*Assistant Examiner*—Eric Golightly
(74) *Attorney, Agent, or Firm*—Greenblum & Bernstein P.L.C.

(57) ABSTRACT

An object is to improve the cleanness achieved by washing through effectively suppressing the residual of solvent remained on a wash-target after washing. The present invention is a wash-target holder soaked in a wash tank by holding a wash-target, which comprises a tray for placing the wash-target, a surrounding member, which is provided standing up on a wash-target placing face of the tray, for surrounding the periphery, and a defluxion-restricting member for restricting the defluxion of the wash-target from the tray. In the periphery of the wash-target surrounded by the surrounding member, an opening for letting in and out the solvent used for washing the wash-target is formed.

14 Claims, 10 Drawing Sheets

WASH-TARGET HOLDER AND METHOD FOR WASHING WASH-TARGET USING THE SAME

BACKGROUND OF THE INVENTION

1. Field of the Invention

The present invention relates to a holder for holding wash-targets when washing the wash-targets such as electronic components and fine components and, more specifically, to a holder used at the time of washing by soaking the wash-target in a washing solvent. Also, it relates to a method for washing the wash-targets using the holder.

2. Description of the Related Art

Electronic components formed by semiconductor chips or a small-size precision components require a high cleanness depending on the purpose of their use. Therefore, the components are washed after being manufactured and before being shipped as products or being mounted into a device. Especially, a high cleanness is required in a magnetic head slider which is required to float a magnetic disk low, since it is mounted to a magnetic disk device. Further, the magnetic head slider is a component which requires a highly precise positioning, so that it is required to be surely washed.

Japanese Patent Unexamined Publication No. 6-103511 discloses an example of a method for washing the components. The method disclosed in Japanese Patent Undisclosed Publication No. 6-103511 is a method in which a magnetic head slider is soaked in a wash tank by being held to a holder and ultrasonic washing is performed in that state. The above-described holder is formed by: through-holes formed in lattice form for enclosing the magnetic head slider; a member comprising a net for covering the bottom end openings; and a member comprising a net for covering the upper end openings of the through-holes. The magnetic head slider is enclosed thereby in the through-holes and it is surrounded by the wall face of the through-hole and a pair of the nets which cover both end openings of the through-hole. Thereby, the magnetic head slider is prevented from being projected outside. Further, the size and thickness of the opening of the through-hole is set 1.1-2.5 times the longitudinal and lateral sizes and the thickness of the magnetic head slider, so that the magnetic head slider can freely move within the through-hole. Thereby, the ultrasonic washing performed on the magnetic head slider can be effectively achieved in the wash tank.

However, there is an inconvenience being generated when components are washed by using the holder of Japanese Patent Undisclosed Publication No. 6-103511 as described below. First, the wash-target is surrounded by the wall face forming the through-hole so that the solvent of a washing liquid cannot be easily removed from the wash-target after the washing. Especially, the solvent may remain in four corners (corner parts) of the through-hole and stains can be generated in the wash-target. Further, both sides of the wash-target are held by a net so that damage of ESD (electrostatic discharge) likely to be occurred. Moreover, the wash-target cannot be stably held through the net so that the wash-target may move during the washing by ultrasonic oscillation and collides against the wall face of the through-hole. Due to the impact, there may be a crack or break being generated for causing damage on the wash-target.

SUMMARY OF THE INVENTION

Therefore, it is an object of the present invention to provide a wash-target holder and a method for washing which can improve the cleanness achieved by washing through improving the inconveniences of the above-described conventional case and, specifically, by effectively suppressing the residual of the solvent remained on the wash-target after washing.

The wash-target holder as an embodiment of the present invention is a wash-target holder to be soaked in a wash tank by holding at least one wash-target, comprising:

a tray for placing the wash-targets; a surrounding member being provided standing up on a wash-target placing face for surrounding each of the wash-targets; and a defluxion-restricting member for restricting defluxion of the wash-targets from the tray, wherein an opening for letting in and out a solvent used for washing the wash-targets is formed in peripheries of the wash-targets surrounded by the surrounding member.

In the above-described configuration, the wash-target is enclosed in a region surrounded by a wash-target placing face of the tray and the surrounding members provided on the wash-target placing face, and the defluxion-restricting member is provided over the region. Thereby, the wash-target is held by the wash-target holder so that the wash-target is not separated from the tray. At this time, one face of the wash-target is supported by the tray so that the wash-target can be stably held by the holder. Thereby, it enables to achieve the stabilization of washing. Further, by forming openings in the periphery of the wash-target held by the holder, the solvent can also be let in/out in the horizontal direction (X-Y direction) with respect to the wash-target placing face of the tray. As a result, circulation of the solvent can be promoted for the wash-target surrounded by the surrounding member through the openings so that washing can be effectively achieved. Furthermore, when the wash-target holder is taken out from the wash tank after completing the washing, the solvent can be quickly discharged through the openings. Therefore, it is possible to suppress the generation of stains and the like by suppressing the residual of the solvent remained on the wash-target after washing. Thereby, the cleanness can be improved.

Further, in the configuration, it is desirable to form the surrounding member by a plurality of protrusions. Furthermore, it is desirable to provide at least four protrusions as the surrounding member for a single wash-target. At this time, it is more desirable that the protrusion be in a column shape.

The wash-target is surrounded by a plurality of protrusions so that the wash-target can be held in the same manner as described above and, at the same time, the openings can be formed widely by the spaces between a plurality of the protrusions. Thereby, as described above, discharge of the solvent from the tray can be promoted so that it is possible to suppress the residual of the solvent remained on the wash-target. Therefore, the holder can be formed by a simple configuration and, at the same time, the openings can be formed widely so that the discharge of the solvent after washing can be more promoted. Further, by providing four protrusions or more as the surrounding member, it becomes possible to hold the wash-target appropriately and, at the same time, the openings can be formed widely so that it enables to suppress the residual of the solvent. Also, by forming the surrounding member in a column shape, the residual of the solvent can be further suppressed and, at the same time, the impact on the wash-target is reduced even if the wash-target collides against the surrounding member at the time of washing. Thereby, it enables to suppress damages generated on the wash-target.

Further, it is distinctive in respect that a through-hole opened through the tray is provided on the wash-target placing face of the tray. Thereby, in the placing area of the wash-target, the solvent is discharged to the rear face of the tray through the through-hole. Therefore, it is possible to increase the discharge amount of the solvent after completing the washing, so that the residual of the solvent remained on the wash-target can be further suppressed.

Also, it is distinctive in respect that the defluxion-restricting member is provided by being abutted against the wash-target. By abutting the defluxion-restricting member against the wash-target as described above, the wash-target can be prevented from moving within the region surrounded by the surrounding member at the time of washing, or the moving speed can be suppressed. Thereby, it is possible to suppress the damages on the wash-target generated when the wash-target collides against the surrounding member.

Further, it is distinctive in respect that when the wash-target is a magnetic head slider having a write/read device, the defluxion-restricting member is disposed in such a position that it does not directly come in contact with the write/read device of the magnetic head slider. Thereby, it is possible to suppress the defluxion-restricting member to be in contact with the write/read device which performs writing and reading of data. Therefore, it enables to suppress the damage on the write/read device caused at the time of washing, and the quality of the magnetic head slider as the wash-target can be maintained.

Furthermore, it is distinctive in respect that the defluxion-restricting member is a linear member. Thereby, the wash-target is fastened by the linear member so that the wash-target is not separated from the tray, so that the face of the wash-target opposite to the tray-side face is mostly open. Therefore, letting in/out of the solvent can be more promoted so that it becomes possible to further improve the washing efficiency and to suppress the residual of the solvent.

Further, it is distinctive in respect that at least two of the linear members or more are provided by crossing with each other for the single wash-target. Furthermore, at least a pair of the linear members or more substantially in parallel may be provided for the single wash-target along a prescribed direction, and the above-described linear member may be formed in a lattice form.

Thereby, the top face of the wash-target is covered by a plurality of the linear members so that the wash-target can be stably held. Especially, by holding it at the intersection points of the linear members, the top face of the wash-target can be pressed from a plurality of directions so that it can be more stably held. Further, by forming the linear members in the lattice form, the wash-targets can be simultaneously held in a plurality of areas. Also, by providing a plurality of substantially parallel linear members along the moving direction of the brush in the case of washing by the brush, it suppresses the linear members to become an obstruction for washing. Thereby, it is possible to perform stable washing while maintaining the holding power.

Further, it is distinctive in respect that when a plurality of the wash-targets are disposed on the tray in X-row×Y-column (both X and Y are integers), the defluxion-restricting member is formed by linear member mount frame comprising at least a single linear member in each of the rows and columns, which can be collectively mounted on the entire wash-target placing face of the tray. At this time, a pinching member is provided for pinching the tray and the linear member mount frame. Further, it is distinctive in respect that at least a pair of the pinching members are provided, and the pair of the pinching members are disposed in positions which are symmetrical with respect to the center on the wash-target placing face of the tray.

Thereby, it is possible to mount the frame collectively onto the tray in the state where the linear members which restrict the defluxion of the wash-targets from the tray are mounted to the frame in the positions for respectively corresponding to the wash-targets arranged on the tray, so it is easy to hold a plurality of the wash-targets. At this time, the mounting frame can be easily mounted to the tray through fastening the mounting frame and the tray by the pinching member, so that it is possible to easily hold a plurality of the wash-targets. Furthermore, by positioning the pinching members for fastening the mounting frame to be symmetrical with respect to the center of the tray, it is possible to hold the wash-target holder by the equal pressure.

Further, it is distinctive in respect that the linear member which is the defluxion-restricting member as described above is treated by polytetrafluoroethylene resin. Thereby, the solvent can be easily removed from the linear members and the residual of the solvent remained on the wash-target after washing can be suppressed. Thus, it is possible to suppress the generation of the stains and the like.

Moreover, the present invention also provides a method for washing a wash-target, comprising the steps of: holding a wash-target; soaking the held wash-target to a washing solvent within a wash tank; washing the wash-target in the washing solvent; and eliminating the washing solvent from the wash-target. The step of holding the wash-target is performed by using the wash-target holder. In the step of washing, ultrasonic washing, brush washing, or Micro-bubble washing is performed.

In the method for washing a wash-target in the above-described configuration, the wash-target is held by the above-described wash-target holder. Therefore, stable washing can be achieved in the washing step performed by the ultrasonic washing or brush washing and, at the same time, the damage on the wash-target can be suppressed. Further, the residual of the solvent remained on the wash-target is suppressed in the step for eliminating the solvent so that the generation of stains and the like can be suppressed. Therefore, as described above, it enables to achieve the object of the present invention, which is to perform washing with high cleanness.

The present invention is formed and functions as described above, in which the wash-target is placed on the tray so that the holding stability is increased and the circulation of the solvent is promoted from the periphery of the wash-target. Thereby, washing can be performed effectively. Also, the solvent can be quickly discharged from the tray when being taken out from the wash tank after washing is completed. Therefore, it achieves the excellent effects such as suppressing the residual of the solvent remained on the wash-target and suppressing generation of stains and the like on the wash-target, which cannot be achieved by the related art.

DESCRIPTION OF THE PREFERRED EMBODIMENTS

The present invention is especially distinctive in respect of a tray for placing the wash-target and of a mesh (defluxion-restricting member) for holding the wash-target to the tray for suppressing the residual of the solvent after washing. The specific configuration and the effects will be described hereinafter by referring to embodiments. In the embodiments, a case of using a magnetic head slider as an example of the wash-target will be described. However, the wash-target is not limited to the magnetic head slider. The wash-target holder as the present invention can be utilized for holding various kinds of wash-targets such as components and the like for washing.

First Embodiment

Figure 1:
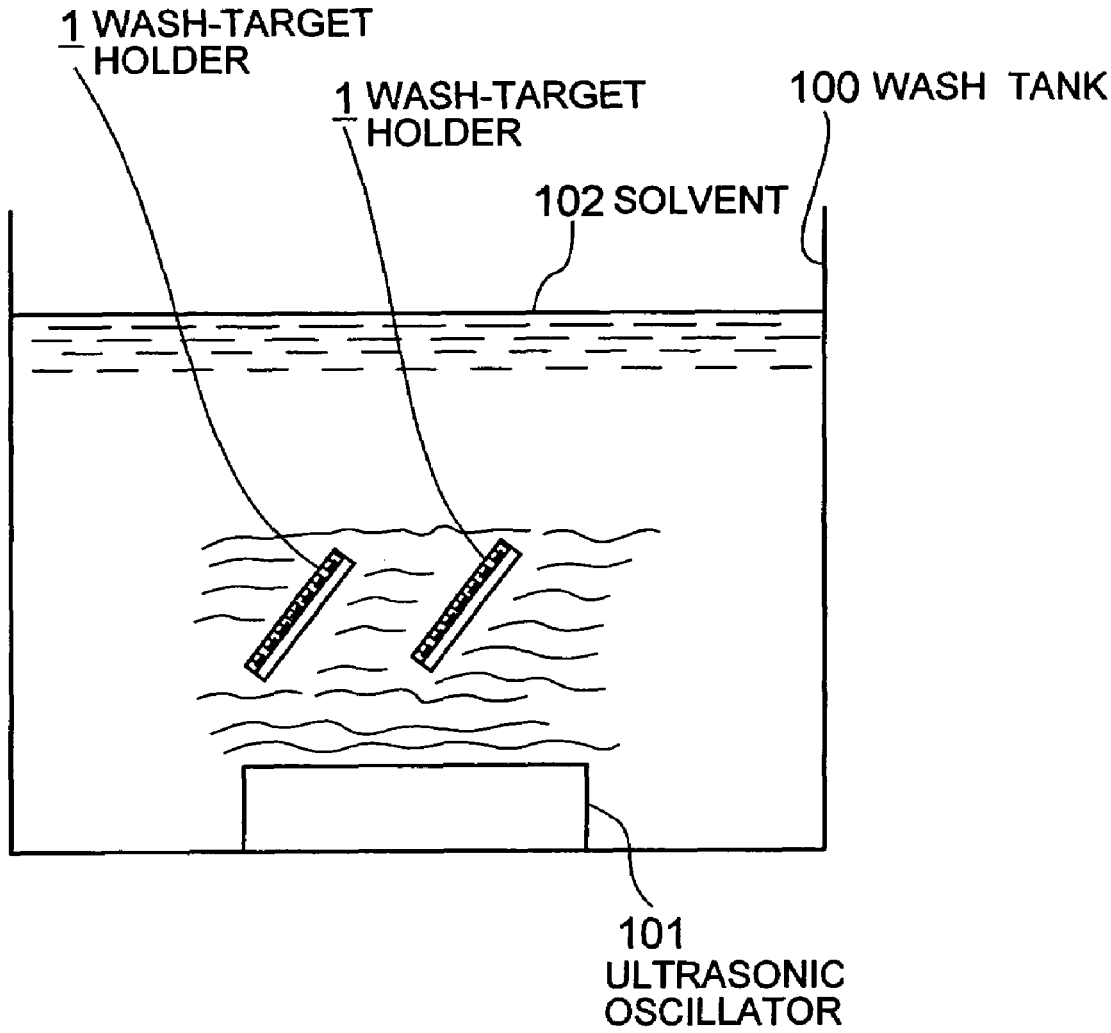
FIG. 1 is a schematic diagram for showing the configuration of a washing device.

A first embodiment of the present invention will be described by referring to FIG. 1-FIG. 6. FIG. 1 is an illustration for showing the schematic view of a washing device for washing a wash-target. FIG. 2-FIG. 6 are illustrations showing the configuration of a wash-target holder.

Configuration

Washing Device

First, by referring to FIG. 1, described is the overall configuration of the washing device for washing the wash-target. As for the washing device, a solvent 102 is filled inside a wash tank 100 to be in a depth by which a wash-target holder 1 is soaked. Further, provided is an ultrasonic oscillator 101 on an inner bottom face of the wash tank 100 in the solvent 102. The ultrasonic oscillator 101 is for generating the ultrasonic oscillation in the solvent 102. By soaking the wash-target holder 1 holding the washing-target in the solvent 102 and generating the ultrasonic oscillation by the ultrasonic oscillator 101, the ultrasonic washing can be achieved on the washing-target. The solvent 102 is prepared with, for example, pure water (DI), isopropyl alcohol (IPA), glycol phthalate (wax), a neutral detergent (about 0.5%).

Wash-Target Holder

Figure 5:
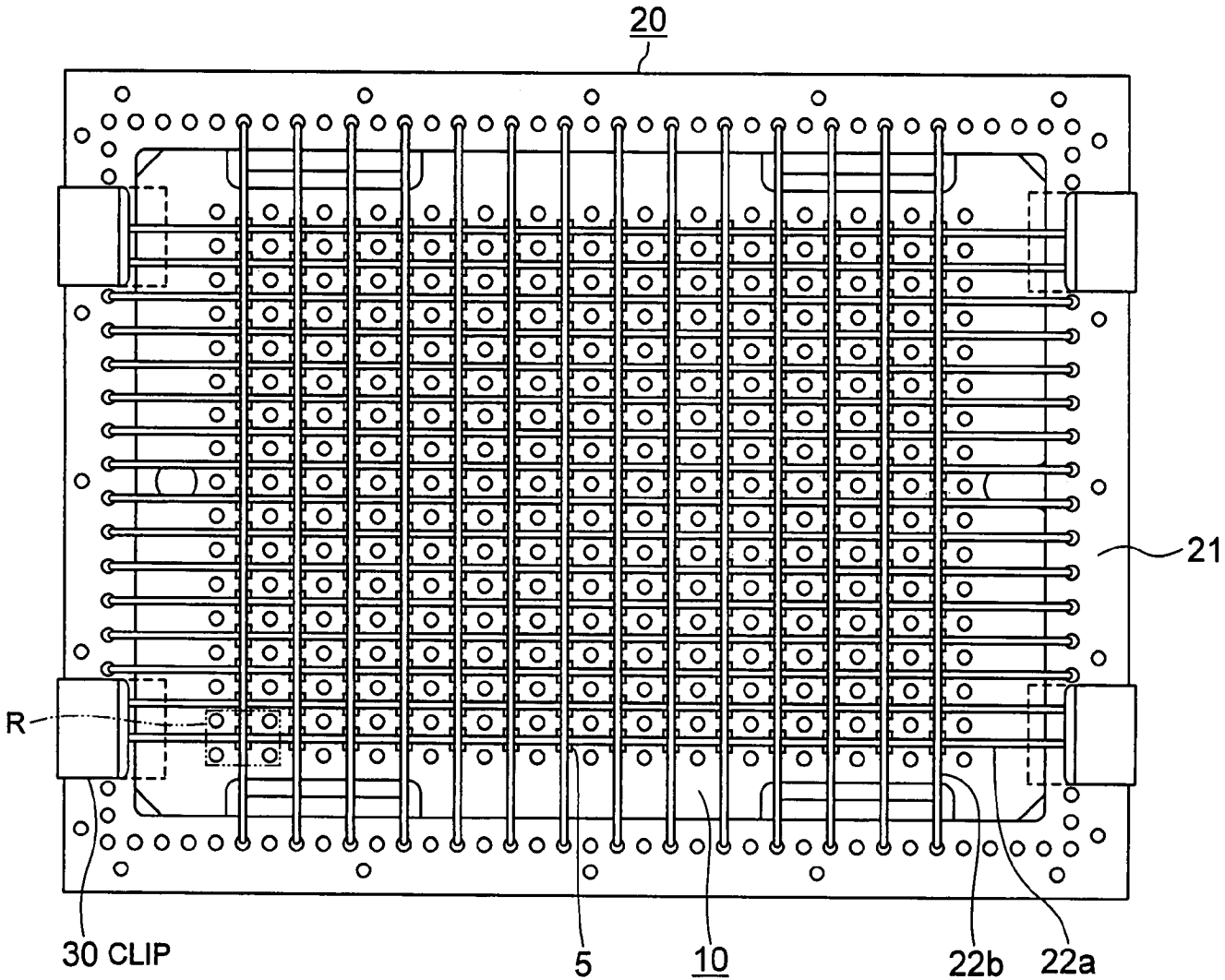
FIG. 5 is a plan view for showing the configuration of the wash-target holder at the time of holding a wash-target.

Next, the wash-target holder 1 will be described in detail. The wash-target holder 1 is a holder for holding a magnetic head slider 5 as the wash-target and soaked within the solvent 102 in the wash tank 100. The wash-target holder 1 is constituted of a tray 10 for placing the magnetic head slider 5, and a mesh 20 (defluxion-restricting member) for restricting the magnetic head slider 5 to be separated and fallen from the tray 10. That is, as shown in FIG. 5 to be described later, in the wash-target holder 1, a plurality of the magnetic head sliders 5 are placed on the tray 10 and are sandwiched by the tray 10 and the mesh 20, thereby holding the magnetic head sliders 5 as the wash-targets. The configuration will be described in more detail hereinafter.

Tray

Figure 2:
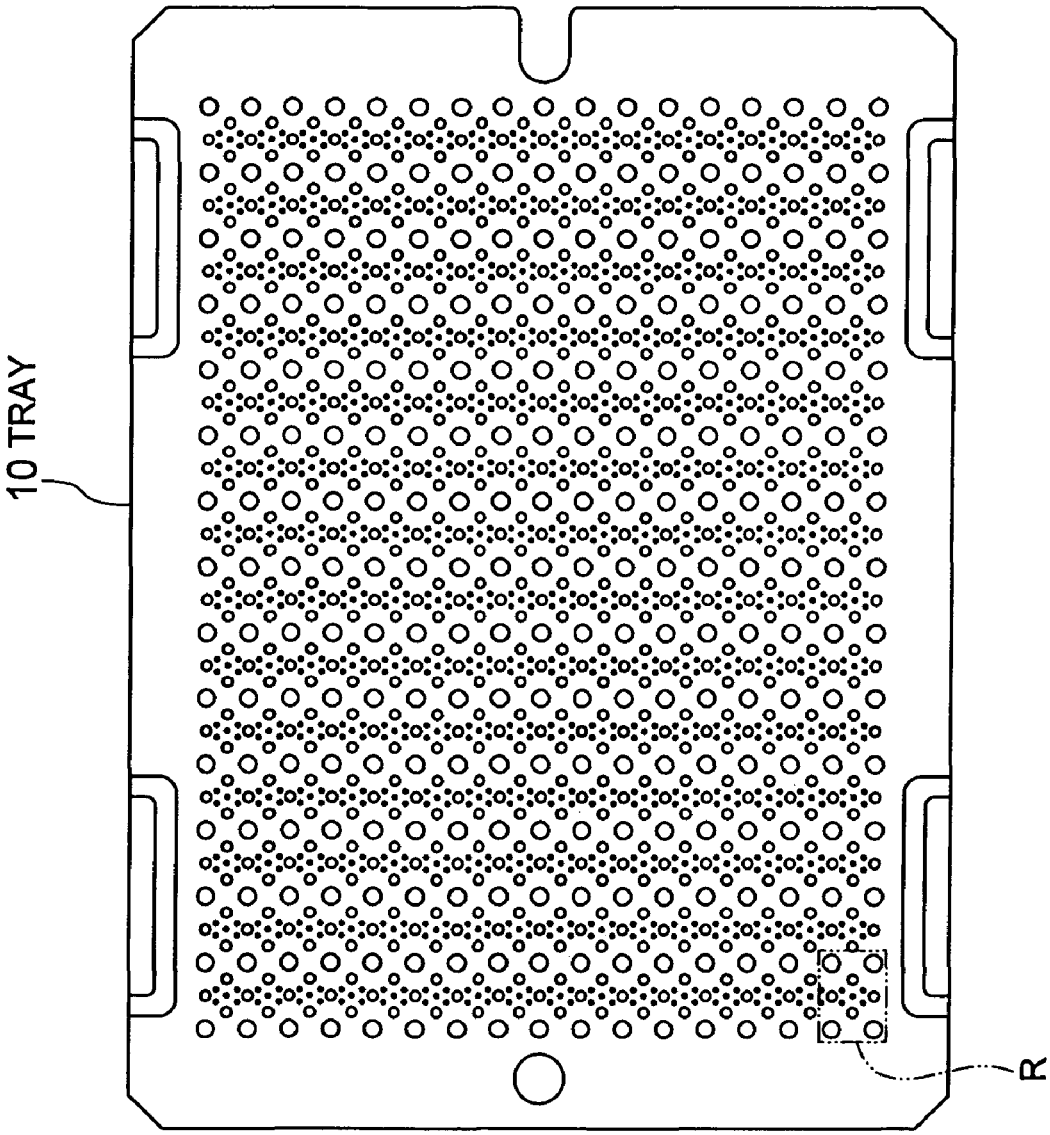
FIG. 2 is a plane view for showing the configuration of a tray constituting a wash-target holder.

The configuration of the tray 10 is shown in FIG. 2-FIG. 3. First, as shown in FIG. 2, the tray 10 is formed in a substantially rectangular shape by a single plate member with a prescribed thickness. The size is substantially the same as that of the inner space of a frame 21 of the mesh 20 to be described later. A large number of protrusions 11 and through-holes 12, 13 are formed on one face of the tray 10, which forms a wash-target placing face where the magnetic head slider 5 is placed. The configuration of the wash-target placing face will be described by referring to FIG. 3.

Figure 3A:
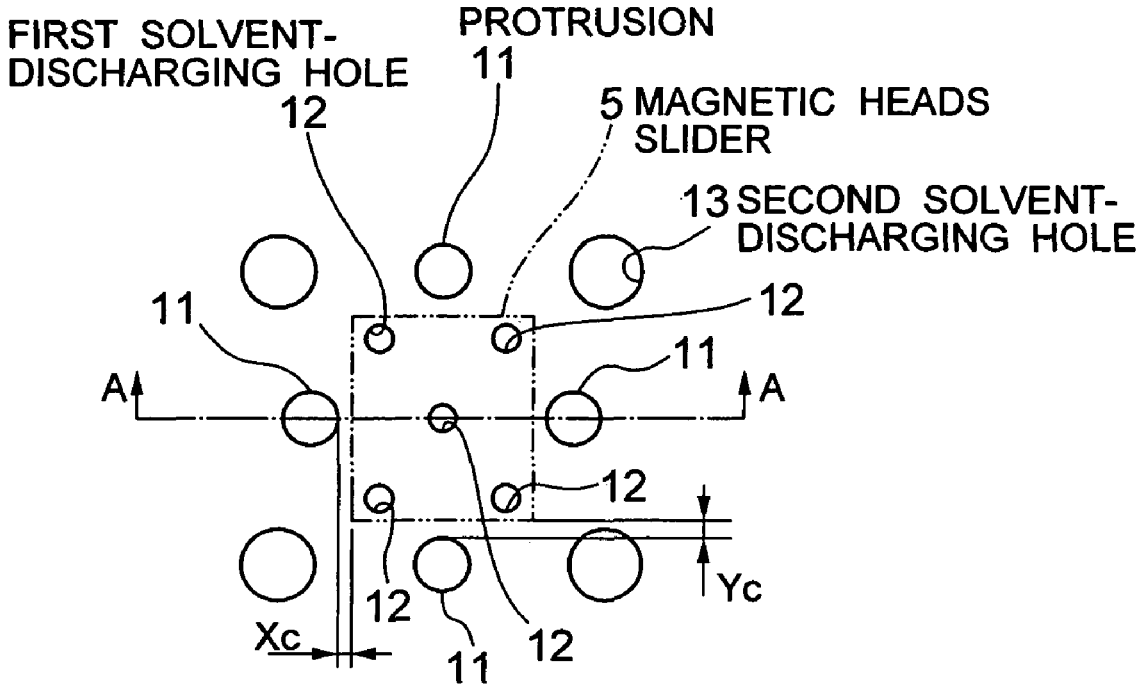
FIG. 3A is an enlarged view for showing a part of the tray.
Figure 3B:
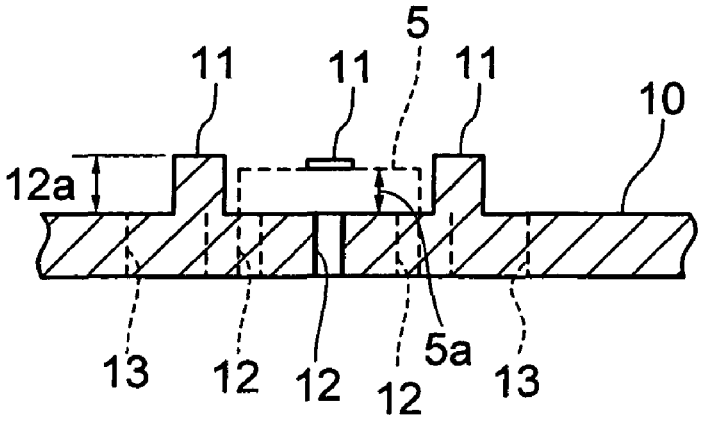
FIG. 3B is a cross section taken along the line A-A of FIG. 3A.

FIG. 3A is an enlarged view of a region R shown in FIG. 2 as a part of the wash-target placing face of the tray 10. Further, FIG. 3B is a cross section taken along the line A-A of FIG. 3A. The above-described region R is continuously formed on the tray 10. For example, the above-described region R is formed on the tray 10 in matrix of X-rows×Y-columns (both X and Y are integers). Therefore, as will be described later, in order to place a single magnetic head slider 5 in each region R, it is possible to place X×Y number of the magnetic head sliders 5 as the wash-targets at the maximum.

As shown in FIG. 3A, first, the magnetic head slider 5 as the wash-target is placed in the center of the region R of the tray 10 and, in the periphery, the protrusions 11 (surrounding member) protruded from the wash-target placing face are formed. The protrusions 11 are substantially a column shape and are formed one each in the center of four sides of the slider 5 which is in substantially the rectangular shape. Thereby, the four protrusions 11 have a function of restricting the magnetic head slider 5 to move in the direction along the wash-target placing face of the tray 10. That is, they are disposed to surround the periphery of the magnetic head slider 5.

By providing at least four protrusions 11 placed to surround the wash-target in accordance with the shape of the wash-target as described, they serve to restrict the movement of wash-targets which are in the shapes other than the magnetic head slider can be achieved. Further, the shape of the protrusion 11 is not specifically limited to the column shape but may be in a square pillar shape. However, the column shape is preferable in consideration of smooth-flow of the solvent 102 and of shock-reduction at the time of colliding with the wash-target. Further, as will be described later, the less the number of the protrusions 11 formed on the entire tray 10, the better the flow-in/out of the solvent 102 becomes. Thus, when washing a plurality of the wash-targets simultaneously, the positions of providing the protrusions 11 are determined so as to reduce the number of the protrusions 11 by commonly using the protrusions 11 which can be shared for holding the neighboring wash-targets.

As the detailed positions of the above-described protrusions 11, for example, when placing the magnetic head slider 5 in the center of each of the protrusions 11 in an idealistic manner as shown in FIG. 3A, there are spaces (Xc, Yc) of about 0.05 mm formed between the protrusions and each side face of the magnetic head slider 5, respectively. Further, as shown in FIG. 3B, a height 12*a* of the protrusion 11 is about 0.4 mm and a height 5*a* (thickness) of the magnetic head slider 5 is about 0.3 mm. However, the dimension is only an example and it is not limited to dimension described above.

Further, since the magnetic head slider 5 is placed on the tray 10 by being surrounded by the above described protrusions 11, the spaces between each protrusion 11 are in an open state. Thereby, openings for letting in/out the solvent for the slider 5 are formed in the periphery of the magnetic head slider. That is, in the spaces between each of the protrusions 11, the side faces of the magnetic head slider 5 are exposed to the solvent 102. Thus, the solvent can also be flown in/out in the horizontal direction (X-Y direction) with respect to the wash-target placing face of the tray. Therefore, the circulation of the solvent 102 for the magnetic head slider 5 can be promoted. Further, when the wash-target holder 1 is taken out from the wash tank 100, the solvent 102 can be quickly discharged from the tray 10 since the side faces of the slider 5 are exposed.

Further, in the tray 10, formed are through-holes 12, 13 opened from the wash-target placing face through the rear face. Specifically, there are five first solvent-discharge holes 12 as relatively small through-holes formed in the placing area of the magnetic head slider 5, which is a region surrounded by the protrusions 11. Outside the protrusions 11, there are four second solvent-discharge holes 13 as relatively large through-holes formed. These through-holes 12 and 13 have the function of circulating the solvent 102. Especially, the first solvent-discharge holes 12 positioned in the rear face of the magnetic head slider 5 functions to discharge the solvent 102 quickly from the wash-target placing position on the tray 10 after washing. Further, the larger the opening size of the solvent-discharge hole 12 is, the more the discharge effect of the solvent becomes. However, if it is too large, the wash-target cannot be held stably. Thus, it is desirable to determine the opening size so that still more effect can be achieved according to the size of the wash-target.

The above-described tray 10 is formed with a mixed resin of Peek resin (poly ether ether ketone resin) and carbon for resolving damage of ESD. However, this material is only an example. It is not limited to this material and it may be a thermoplastic, which is resistant to ESD's damage and has sufficient water-shedding quality, for example.

Mesh

Figure 4:
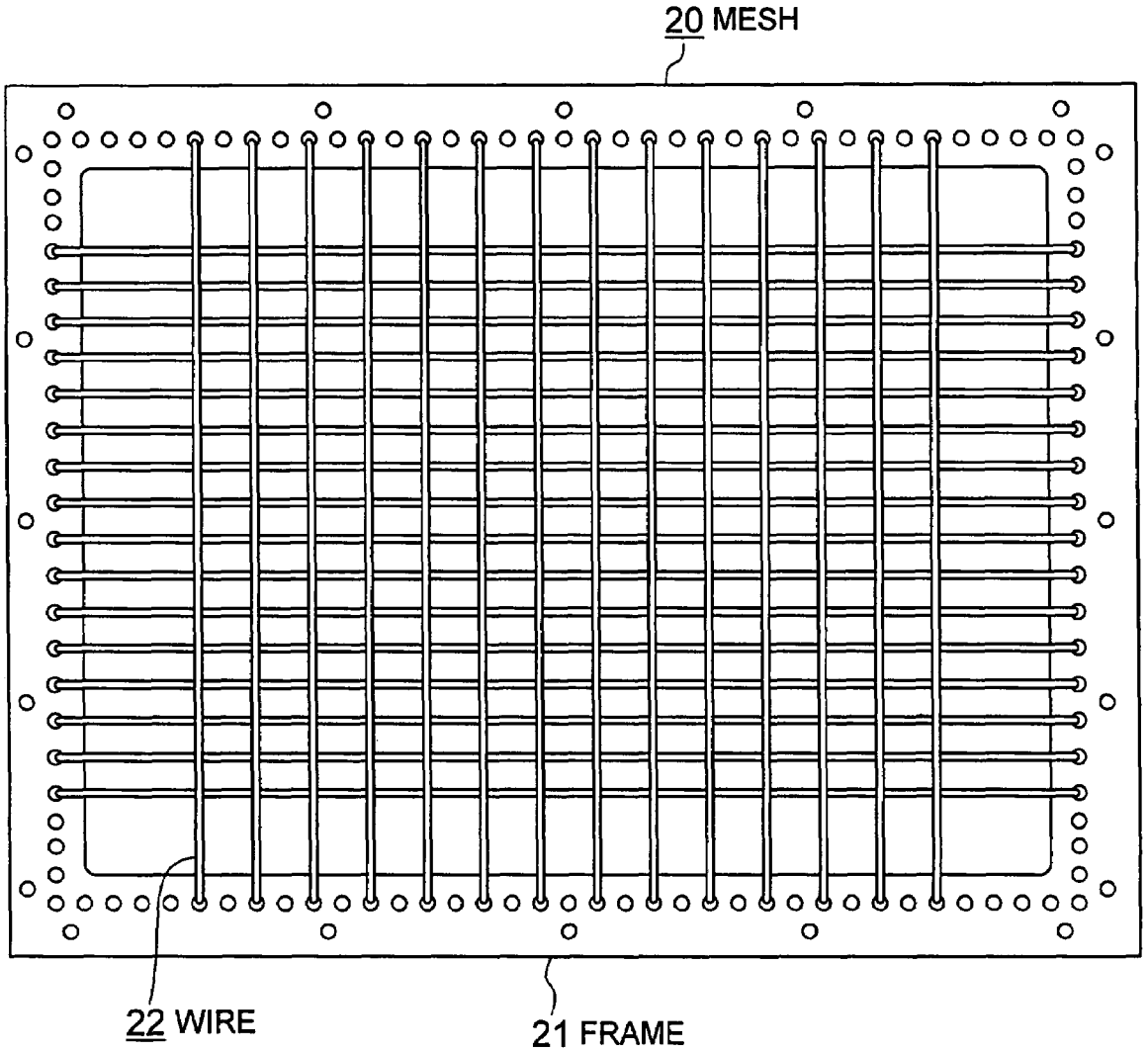
FIG. 4 is a plan view for showing the configuration of a mesh constituting the wash-target holder.

Next, the mesh 20 (linear member mount frame) will be described by referring to FIG. 4. The mesh 20 is constituted of: a frame 21 whose inner part is hollow and a size larger than the above-described tray 10; and a wire 22 (linear member, defluxion-restricting member) provided in lattice form over the space of the frame 21.

Specifically, there are a large number of through-holes provided in the periphery of the frame 21 for inserting the wire 22. By inserting the wire 22 in the through-holes formed in opposing sides of the frame, it is formed in a mesh form (lattice form) in crosswise direction. At this time, the each space of the wire 22 is set according to the magnetic head slider 5 to be placed on the tray 10, so that each intersection point of each wire comes to be in the position over each of the magnetic head sliders 5. That is, at least a single wire 22 is provided in each row and each column by corresponding to the lines of X-row×Y-column in the region R of the tray 10. This state will be described later by referring to FIG. 5.

The wire 22 is formed, for example, by nylon with a diameter of 0.1 mm containing carbon and, especially, the surface is treated by polytetrafluoroethylene (Teflon-lined). Thereby, the solvent 102 is easily removed from the wire 22 after being taken out from the solvent 102 so that it enables to prevent the solvent from being remained on the wash-target after washing. The above-described material of the wire 22 is only an example and it is not limited to this. For example, the one which is resistant to ESD damage and has sufficient water-shedding quality may be used. Further, the member (defluxion-restricting member) for holding the magnetic head slider 5 as the wash-target is not limited to the one in a wire form.

Action

The tray 10 and the mesh 20 are formed in the manner as described above. The action of mounting these for enabling to hold the magnetic head slider 5, the holding state, and the washing operation (that is, washing method) will be described by referring to FIG. 5 and FIG. 6.

First, in a step for holding the wash-target, the wash-target is placed in such a manner that each of the magnetic head sliders 5 is enclosed in each placing area surrounded by each protrusion 11 on the wash-target placing face of the tray 10, and the mesh 20 is put on from the above. At this time, the tray 10 is placed so as to be enclosed inside the frame 21 of the mesh 20, and the tray 10 and the mesh 20 are unified by being pinched by a plurality of clips 30 (pinching member) mounted in the periphery. The clips 30 are spring pinching members formed substantially in a U-shape. As shown in FIG. 5, for example, the clip 30 is formed in such a manner that the portion positioned in the face side opposite to the illustrated face side is longer than the portion in the illustrated side so as to be in contact with a part of the tray 10 (see the dotted line part).

Figure 6A:
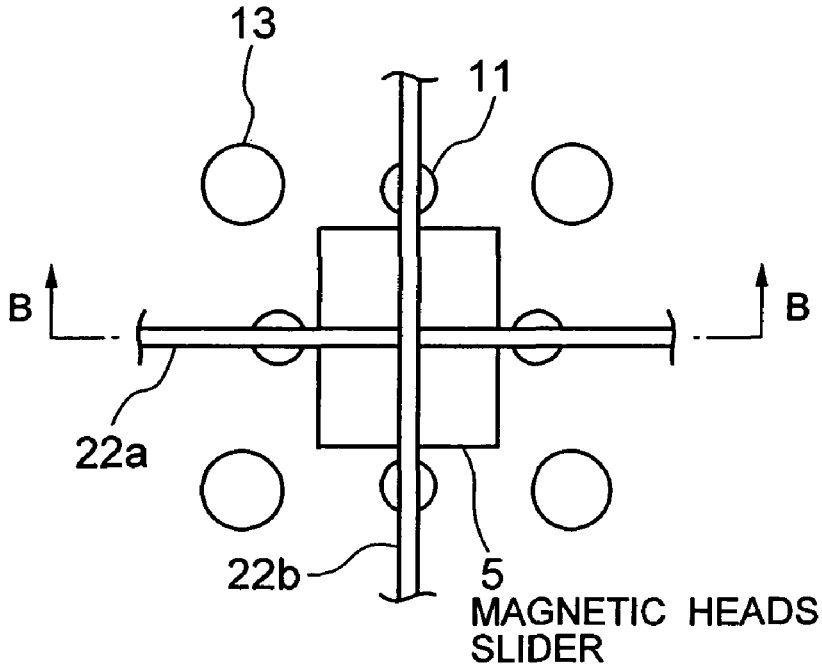
FIG. 6A is an enlarged view for showing a part of the wash-target holder shown in FIG. 5.
Figure 6B:
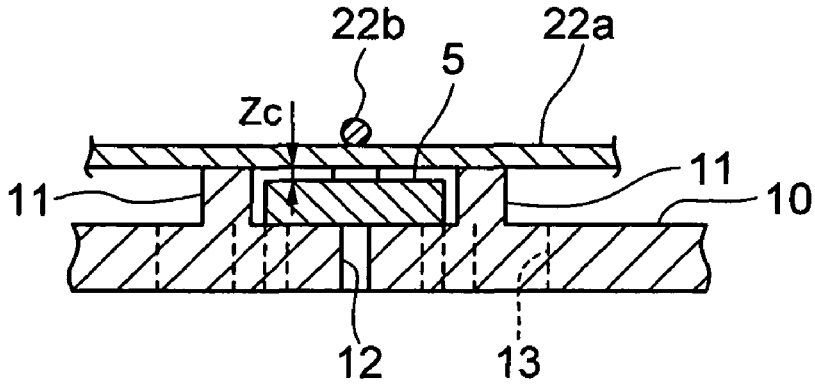
FIG. 6B is a cross section taken along the line B-B of FIG. 6A.

The state of holding the magnetic head sliders 5 in the manner as described above will be described by referring to the enlarged view of FIG. 6. FIG. 6A shows the region denoted by a reference numeral R in FIG. 5 and is an illustration for showing the state where the magnetic head slider 5 is held in the region R shown in FIG. 2. The cross section taken along the line B-B is shown in FIG. 6B. First, as shown in FIG. 6A, one side of the magnetic head slider 5 is supported by the wash-target placing face of the tray 10 and its side face (periphery) is surrounded by the protrusions 11. Further, on the other face side (the illustrated face side), wires 22*a*, 22*b* of the mesh 20 are provided over by crossing with each other. Thereby, it restricts the magnetic head slider 5 to be projected away from the wash-target placing face being separated therefrom in the direction of the separation.

At this time, the wires 22*a*, 22*b* are supported by the protrusions 11 so that there is a space Zc of about 0.1 mm being generated between the magnetic head slider 5 and the wires 22*a*, 22*b* due to the difference in the height of the protrusion 11 and that of the magnetic head slider 5. However, the space Zc between the magnetic head slider 5 and the wires 22*a*, 22*b* may be set about 0.05 mm when the wires 22*a*, 22*b* are loosened and dropped down or the wire 22*a* in the lateral direction is pressed downwards by the wire 22*b* in the longitudinal direction. Further, there may be some cases where the magnetic head slider 5 comes in contact with the wire 22*a* by the loosening or the pressure of other wire crossing therewith. In this case, the magnetic head slider 5 is pressed against the tray 10 by the wire 22*a* and the magnetic head slider 5 is more stably held. Especially, in a washing step by ultrasonic washing to be described later, the space Zc is generated by oscillation even if the magnetic head slider 5 and the wire 22*a* are in contact, so that it enables to suppress the unwashed part to be remained.

Next, the action at the time of washing will be described. As shown in FIG. 5 and FIG. 6, the wash-target holder 1 holding the magnetic head slider 5 as the wash-target is soaked in the solvent 102 in the wash tank 100. At this time, as shown in FIG. 1, although the position of the wash-target holder 1 is unstable in the solvent 102, the magnetic head slider 5 is stably held to the holder 1 since it is surrounded by the tray 10, the protrusion 11, and the mesh 20 as described above. Especially, the magnetic head slider 5 is held by the wash-target placing face of the tray 10 so that it is more stably supported compared to a conventional case. Thus, the movement of the magnetic head slider 5 itself is restricted. Further, when the magnetic head slider 5 is in contact with the wire 22 to be pressed against the tray 10, it is possible to suppress the magnetic head slider 5 to move on the tray 10 or the moving speed even though it moves. Thereby, it suppresses the slider 5 to collide against the protrusion 11 surrounding the periphery or it enables to reduce the colliding speed. Therefore, it is possible to suppress damages such as cracks generated in the magnetic head slider 5 by an impact.

Subsequently, the in the washing step, the ultrasonic washing of the magnetic head slider 5 is performed through generating ultrasonic oscillation in the solvent by the ultrasonic oscillator 101 disposed in the bottom face of the wash tank 100. At this time, there is only the wire 22 on one face side of the magnetic head slider 5 and almost the entire face is exposed outside. Further, there are only four protrusions 11 on the side face part of the magnetic head slider 5 so that it is exposed outside except for proximal position. Further, there are also the first and the second solvent-discharging holes 12, 13 formed on the tray 10 on the magnetic head slider 5 side. Therefore, the solvent 102 effectively circulates the outer face of the magnetic head slider 5 so that washing by the ultrasonic oscillation can be effectively performed.

When the washing is completed and the wash-target holder 1 is taken out from the wash tank 100, the solvent 102 can be quickly discharged from the tray 10, since the mesh 20 side and the side face part of the magnetic head slider 5 is almost open, and the mesh 20 is Teflon-lined, and further, there are the solvent-discharging holes 12, 13 formed on the tray 10. Thereby, it enables to suppress the residual of the solvent 102 remained on the magnetic head slider 5 and generation of stains and the like can be suppressed.

In the above-described embodiment, the protrusion 11 in the column shape is used as the member (surrounding member) for surrounding the periphery of the magnetic head slider 5 as the wash-target, however, it is not limited to this shape. For example, it may be a member having wall faces provided intermittently on the wash-target placing face of the tray 10. In this case, the discontinued formed by intermittently providing the members function as the openings for releasing the solvent when taking out the tray from the wash tank after washing. Thereby, the same effect as described above can be achieved. Further, the surrounding member is not limited to the above-described shape. The surrounding member may be provided by forming it by a continuous wall face which completely surrounds the periphery of the wash-target and forming through-holes to be the openings in the wall face.

Further, a micro-bubble generating device may be provided in the solvent instead of the above-described ultrasonic oscillator 101. Thereby, the wash-target can be washed by the micro-bubble generated by the micro-bubble generating device.

Second Embodiment

Next, a second embodiment of the present invention will be described by referring to FIG. 7-FIG. 9. FIG. 7 and FIG. 8 are enlarged views for showing the region R shown in FIG. 2, which show the state where the magnetic head slider 5 as the wash-target is held by the wash-target holder 1, respectively. Further, FIG. 9 is a schematic view for showing the configuration of a washing device using brush washing. In the embodiment, each positioning of the mesh 20 and the wire 22 is different from the case of the above-described first embodiment.

Figure 7A:
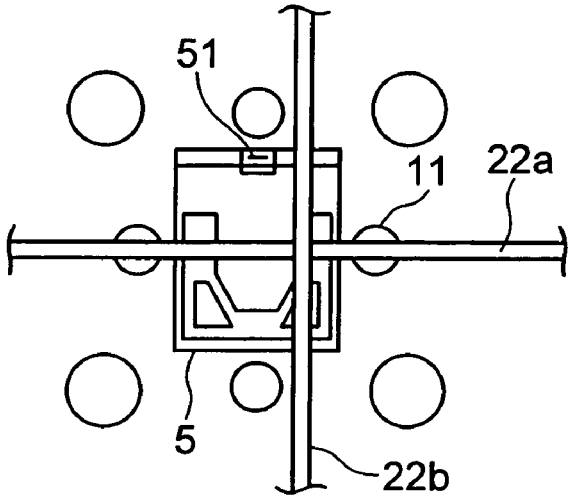
FIGS. 7A, B are plan views for showing other configurations of the mesh, respectively, and show the state at the time of holding the wash-target.

First, the case shown in FIG. 7A will be described. The wire 22 for pressing the top face (the opposite side to the tray 10) of the wash-target does not necessarily pass through the center in the longitudinal or lateral direction of the wash-target placed on the tray 10. As shown in the drawing, the wire 22 may be disposed by being shifted from the center of the longitudinal or lateral direction of the magnetic head slider 5 as the wash-target. That is, the mesh 20 is so formed in advance that the wires 22*a*, 22*b* are placed as shown in the drawing (the mesh 20 is not illustrated). Specifically, in the case of this drawing, it is so formed that the wire 22*b* in the longitudinal direction does not pass through the center of the short side of the magnetic head slider 5. There is a write/read device 51 for performing writing/reading of data mounted in the center of one end portion of the magnetic head slider 5, so that the wire 22*b* is disposed by avoiding the device 51 so as not to be directly in contact. By forming the mesh 20 as described above, it is possible to suppress damages of the write/read device 51 at the time of washing, thereby enabling to maintain the quality of the magnetic head slider 5.

The width of the write/read device 51 in the lateral direction is about 0.03 mm. Thus, in consideration of space Xc (about 0.05 mm) between the magnetic head slider 5 and the protrusion 11 as described above (see FIG. 3A), the wire 22*b* may be placed by being shifted by about 0.08 mm or more from the center of the lateral direction.

Even in the case where the wire 22*b* in the longitudinal direction is placed in the center of the short side of the magnetic head slider 5 as shown in FIG. 6A, the wire 22*b* on the device 51 side may be intersected with the other wire 22*a* with the wire 22*b* being on the top as shown in FIG. 6A. Thereby, the space Zc between the device 51 and the wire 22*b* can be formed large. Thus, it enables to suppress the contact of the wire 22*b* with the device 51, thereby suppressing damages caused in the device 51.

Figure 7B:
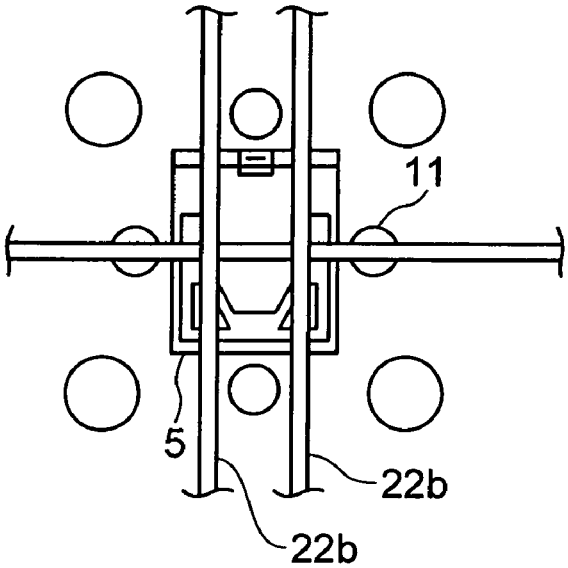

Further, as shown in FIG. 7B, there may be two wires 22*b* in the longitudinal direction provided by being shifted from the center in the lateral direction of the magnetic head slider 5. Thereby, the slider 5 can be held by the holder 1 stably. Especially, at the time of washing performed by the washing device using a roll brush 104, it is possible to suppress the shift of the wash-target by a force applied by the roll brush 104 through providing two wires 22*b* in the moving direction of the roll brush 104 (that is, in the brushing direction) as the washing equipment.

Now, the washing device using the roll brush 104 of FIG. 9 will be described. The washing device comprises a pedestal 103 for placing, on its top face, the wash-target holder 1 holding the wash-target inside the wash tank 100, and the solvent 102 is filled in the amount by which the top face of the pedestal 103 is soaked. Further, the roll brush 104 for washing the wash-target is provided above. Specifically, there is a concave part (not shown) formed in the top face of the pedestal 103 for disposing the wash-target holder 1 in substantially a rectangular shape so as to fixedly support the wash-target holder 1 enclosed in the concave part. However, the pedestal 103 in other configuration may support the wash-target holder. Further, the roll brush 104 also comprise a driving device such as a motor for rotating the brush part and a movable device for moving the position of the roll brush 104, so that it is rotated and moved at the position where the tips of the brush come in contact with the surface of the wash-target holder 1 and performs washing by brushing along one direction.

Figure 8A:
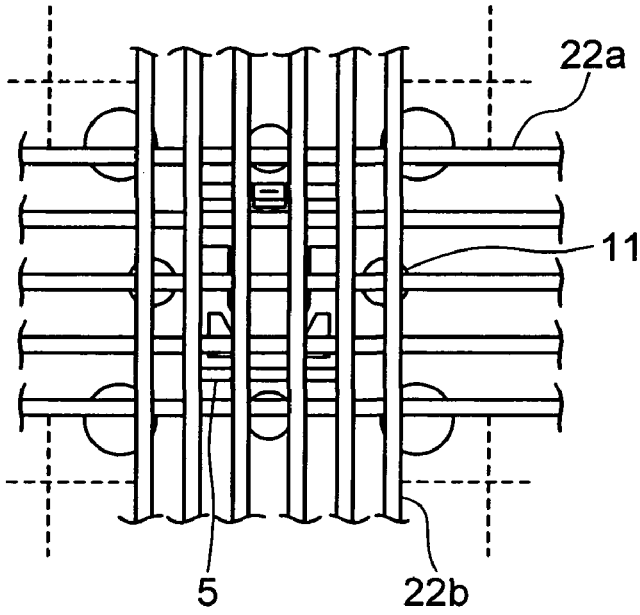
FIGS. 8A, B are plan views for showing other configurations of the mesh, respectively, and show the state at the time of holding the wash-target.

Further, FIG. 8 shows a modification example of the positioning of the wire 22. In FIG. 8A, the mesh 20 is formed in which the lattice spaces between the wires 22*a*, 22*b* are narrowed. At this time, the mesh 20 is formed in advance in such a manner that, for example, the lattice space is 0.08-0.10 mm and each of the wires 22*b*, 22*a* in the longitudinal and lateral directions is not to be placed over the write/read device 51 of the magnetic head slider 5. Thereby, the magnetic head slider 5 can be pressed against the tray 10 from the above by a plurality of the wires 22*a*, 22*b* in lattice form, thereby increasing the stability of holding.

Figure 8B:
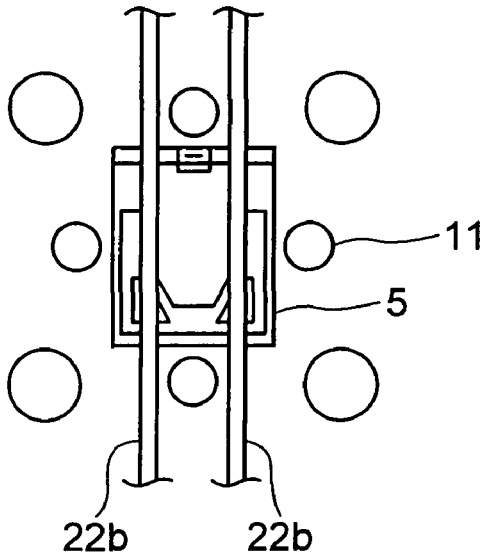
Figure 9:
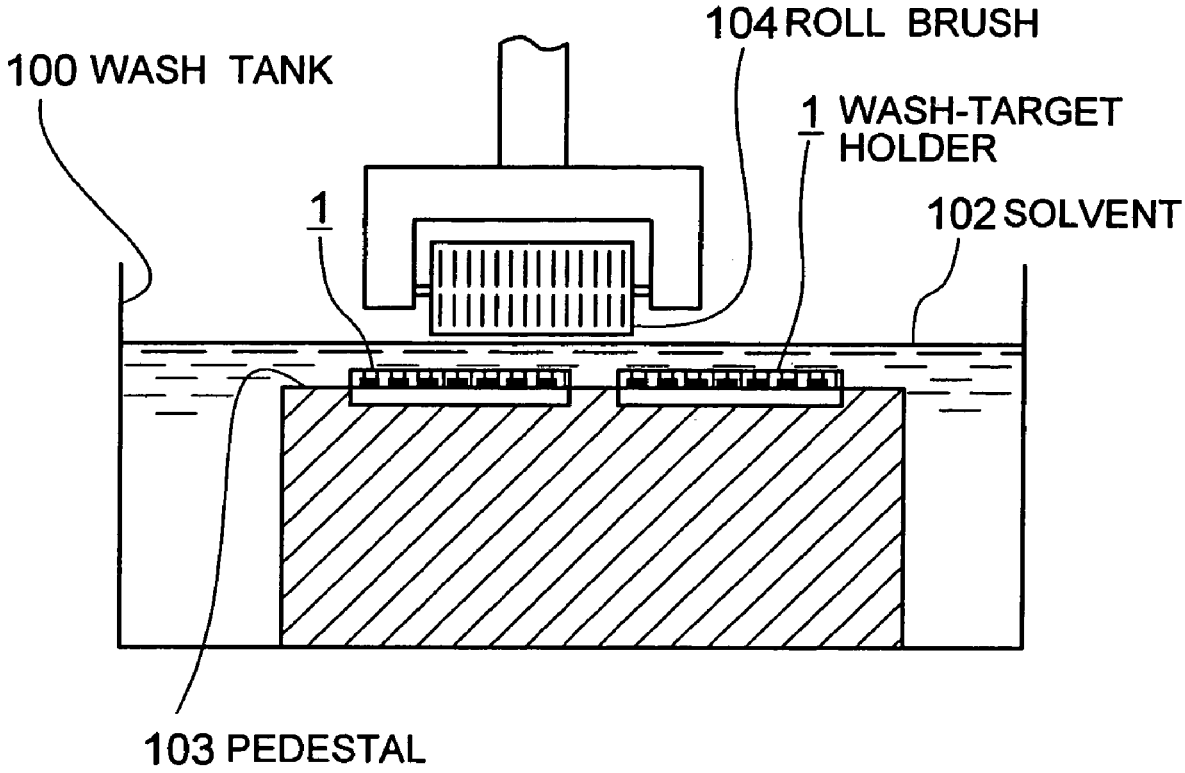
FIG. 9 is a schematic view for showing other configuration of the washing device.

Meanwhile, FIG. 8B shows the configuration in which the number of the wire 22 is reduced and the target is pressed by only the wire 22*b* in one direction. By the two wires 22*b* provided in the same direction, it is also possible to stably hold the magnetic head slider 5 on the tray 10. As shown in FIG. 9, when using a brush such as the roll brush 104 and the like, a large force is directly applied on the wires 22*a*, 22*b* by the brush. Thus, the wash-target may be largely moved so that it is desirable to increase the number of the wire 22. It is preferable to provide a plurality of the wires which are extended along the moving direction of the brush since the force is applied for a longer time in that direction.

The state of washing by using the washing device shown in FIG. 9 will be described. First, in the same manner as described above, the magnetic head slider 5 is held to the tray 10 and the mesh 20 so as to be placed on the pedestal 103 inside the wash tank 100. The roll brush 104 is rotated and moved for brushing the mesh side face of the wash-target holder 1 for washing. At this time, there is only the wire 22 present on the face of the magnetic head slider 5 with which the roll brush 104 comes in contact and almost the entire surface is exposed outside. Thus, it is possible to perform brushing all over the surface. Further, there are only four protrusions 11 on the side face part of the magnetic head slider 5 so that it is exposed outside except for proximal position. Further, there are also the first and the second solvent-discharging holes 12, 13 formed on the tray 10 on the magnetic head slider 5 side. Therefore, the solvent 102 effectively circulates the periphery of the magnetic head slider 5 so that washing by the solvent can be effectively performed. When the washing is completed and the wash-target holder 1 is taken out from the wash tank 100, the solvent 102 can be quickly discharged from the tray 10, since the mesh 20 side and the side face part of the magnetic head slider 5 is almost open, and the mesh 20 is Teflon-lined, and further, there are the solvent-discharging holes 12, 13 formed on the tray 10. Thereby, it enables to suppress the residual of the solvent 102 remained on the magnetic head slider 5 so that generation of stains and the like can be suppressed.

Although the above-described configurations of the mesh 20 shown in FIG. 7B and FIGS. 8A, B can be applied to all types of washing devices, they are especially effective for brush washing since the target can be stably held through the configurations. In the meantime, as for the mesh structure used for the ultrasonic washing described in the first embodiment, a larger space can be provided for the lattice space of the mesh 20, since a large force is not applied on the wash-target unlike the brush washing. The exposed portion of the wash-target becomes large by providing the large lattice space so that the washing effect can be increased. However, if the space is too large, the wash-target cannot be stably held. Therefore, it is desirable to determine the lattice space according to the size of the wash-target so that the better effect can be achieved. Further, in order to provide the large lattice space in the mesh 20 used for ultrasonic washing, it is possible to form the wire 22 of the mesh thinner than the one used for the brush washing.

Third Embodiment

Figure 10A:
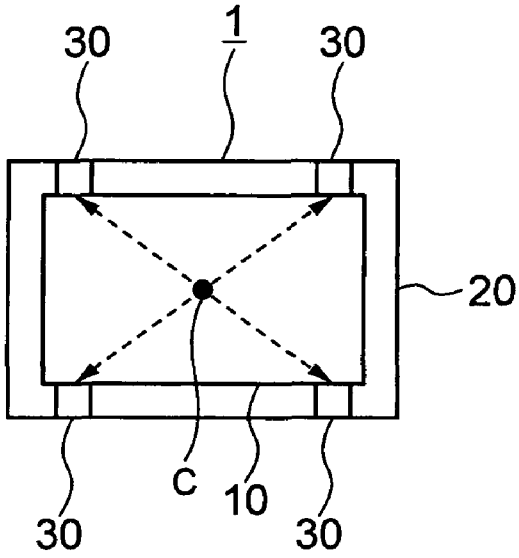
FIGS. 10A, B are illustrations for showing positioning examples of the clip, respectively.
Figure 10B:
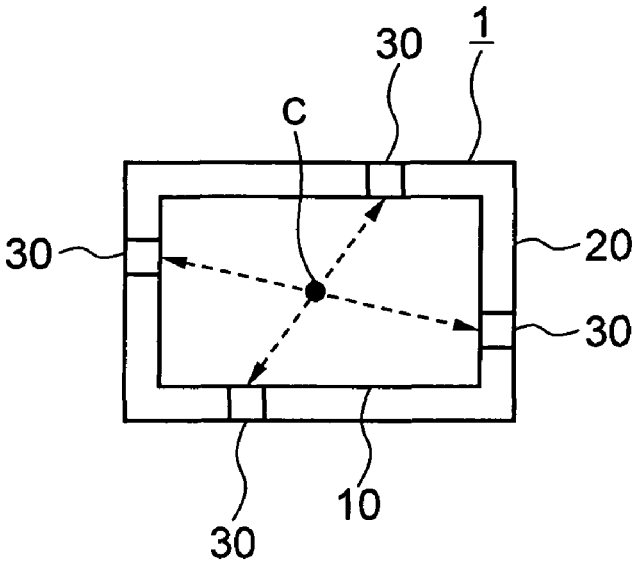

Next, a third embodiment of the present invention will be described by referring to FIG. 10. FIGS. 10A and 10B show positioning examples of the clips 30 for pinching the tray 10 and the mesh 20, respectively. In both of the examples shown in the drawings, the tray 10 and the mesh 20 are pinched by four clips 30 and the clips 30 are positioned to be in symmetrical with respect to the center C of the tray 10. Specifically, they are positioned in such a manner that a pair of the two clips 30, which are correspondingly shown in FIGS. 10A, B by dotted arrows, are point-symmetrical with respect to the point C which is the intersection point of the diagonals of the tray 10 in substantially a rectangular shape and the mesh 20. That is, in the case of FIGS. 10A, B, two pairs of the clips 30 are positioned point-symmetrically with respect to the center C of the mesh 20, respectively, so that a total of four clips are disposed. The center of the point symmetry may be the center of gravity of the holder 1.

Thereby, the tray 10 and the mesh 20 can be pinched by the equal pressure through the pinching force of the clips 30. Although the embodiment has been described by referring to the case of providing four clips 30, it is not limited to this number. However, in order to obtain the equal pressure for pinching, as described above, it is desirable to provide a plurality of pairs of clips 30. Thus, it is desirable to provide the even number of the clips as a whole. In order to suppress dirty part occurred by the clips, it is desirable to provide less number of the clips. Therefore, it is especially preferable to provide four clips which enables to stably hold the mesh and the tray by the equal pressure with generating minimum dirty part.

The present invention is a wash-target holder which can be utilized in washing performed by using a solvent in a wash tank, so that it has the industrial applicability.

What is claimed is:

1. A wash-target holder configured to be soaked in a wash tank and to hold at least one wash-target, the wash-target holder comprising:

a tray formed by a plate member, the plate member having a wash-target placing face where a face of the at least one wash-target is placed, and the at least one wash-target having side faces defined at a periphery of the face of the at least one wash-target;

a surrounding member being provided on the wash-target placing face of the plate member to surround each of the at least one wash-target; and a defluxion-restricting member which restricts defluxion of the at least one wash-target from the wash-target placing face of the plate member comprising a mesh, wherein an opening is configured to let in and out a solvent in a horizontal direction with respect to the wash-target placing face to wash the at least one wash-target, the opening being formed in peripheries of at least one of the side faces of the at least one wash-target, such that the at least one of the side faces of the wash-target is exposed to solvent, and the surrounding member being integral with the plate member and having intermittently spaced surfaces which intermittently spaced surfaces are substantially perpendicular to the wash-target placing face of the plate member, wherein a spacing formed by the intermittently spaced surfaces defines the opening which lets the solvent in and out at the peripheries of the at least one side face of the at least one wash-target, and the intermittently spaced surfaces restrict movement of the wash-target in a direction along the wash-target placing face.

2. The wash-target holder according to claim 1, wherein the surrounding member comprises a plurality of protrusions.

3. The wash-target holder according to claim 2, wherein the plurality of protrusions comprises at least four protrusions provided as the surrounding member, the surrounding member corresponding to each of the at least one wash-target.

4. The wash-target holder according to claim 2, wherein the protrusions are columns.

5. The wash-target holder according to claim 1, wherein a through-hole opened through the plate member is provided on the wash-target placing face of the plate member.

6. The wash-target holder according to claim 1, wherein the defluxion-restricting member is provided by abutting against the wash-target.

7. The wash-target holder according to claim 1, wherein:

the wash-target is a magnetic head slider having a write/read device; and the defluxion-restricting member is disposed in a position so that it does not directly come in contact with the read/write device of the magnetic head slider.

8. The wash-target holder according to claim 1, wherein the mesh comprises at least two linear members corresponding to each of the the at least one wash-target.

9. The wash-target holder according to claim 1, wherein the mesh comprises at least a pair of linear members substantially in parallel, the pair of linear members corresponding to each of the at least one wash-target.

10. The wash-target holder according to claim 9, wherein at least two of the linear members are provided in a lattice form.

11. The wash-target holder according to claim 1, wherein:

a plurality of wash-targets are positioned on the plate member in X-row×Y-column (both X and Y are integers); and the defluxion-restricting member is formed by a linear member mount frame comprising at least a single linear member in each of the rows and columns, which are configured to be collectively mounted on the entire wash-target placing face of the plate member.

12. The wash-target holder according to claim 11, wherein at least one pinching member is provided to pinch the plate member and the linear member mount frame.

13. The wash-target holder according to claim 1, wherein at least a pair of pinching members are disposed in positions which are symmetrical with respect to the center on the wash-target placing face of the plate member.

14. The wash-target holder according to claim 1, wherein the linear member is treated by polytetrafluoroethylene resin.

* * * * *

UNITED STATES PATENT AND TRADEMARK OFFICE

CERTIFICATE OF CORRECTION

PATENT NO. : 7,748,395 B2
APPLICATION NO. : 11/065366
DATED : July 6, 2010
INVENTOR(S) : T. Satoyoshi et al.

It is certified that error appears in the above-identified patent and that said Letters Patent is hereby corrected as shown below:

At Column 14, line 14 (Claim 13, line 1) of the printed patent, replace number "1" with the number --12--.

Signed and Sealed this
Twenty-second Day of February, 2011

David J. Kappos

David J. Kappos
*Director of the United States Patent and Trademark Office*